US006093006A

United States Patent [19]

Arbocast et al.

[11] Patent Number: 6,093,006

[45] Date of Patent: Jul. 25, 2000

[54] NON-CRESCENT SEAL INTERNAL GEAR PUMP WITH SEALING ELEMENTS INSERTED IN THE TOOTH TIPS

[75] Inventors: Franz Arbocast; Peter Peiz, both of Heidenheim, Germany

[73] Assignee: Voith Turbo GmbH & Co. KG, Germany

[21] Appl. No.: 09/041,261

[22] Filed: Mar. 12, 1998

[30] Foreign Application Priority Data

Mar. 22, 1997 [DE] Germany ..... 197 12 169

[51] Int. Cl.[7] ..... F04C 2/10

[52] U.S. Cl. ..... 418/125; 418/168

[58] Field of Search ..... 418/112, 113, 418/122–124, 168, 125

[56] References Cited

U.S. PATENT DOCUMENTS

| | | | |
|---|---|---|---|
| 60,366 | 12/1866 | Hardy et al. | 418/112 |
| 3,171,587 | 3/1965 | Schaller et al. | 418/61.2 |
| 3,238,929 | 3/1966 | Brodbeck et al. | 418/117 |
| 5,399,079 | 3/1995 | Peiz et al. | 418/168 |

FOREIGN PATENT DOCUMENTS

| | | | |
|---|---|---|---|
| 545424 | 12/1992 | European Pat. Off. . | |
| 3633330 | 4/1988 | Germany | 418/168 |

*Primary Examiner*—John J. Vrablik
*Attorney, Agent, or Firm*—Ostrolenk, Faber, Gerb & Soffen, LLP

[57] ABSTRACT

A non-crescent seal gear pump includes a housing with a pump chamber, a rotatable ring gear in the pump chamber having an outer periphery and internal toothing and an eccentric pinion with external toothing and rotatable in mesh with the rotatable ring gear at one circumferential side of the ring gear and the pinion and the ring gear. The tooth tips of the ring gear have grooves in which are inserted radially movable sealing elements that are movable radially slightly. The sealing elements in the ring gear and the teeth of the pinion are so placed as to slide past each other at the other circumferential side of the ring gear. A distribution groove is worked into either the wall of the profile groove and/or into the sealing element at the wall and the distribution groove extends axially along the sealing element. Radial legs may project outwardly from the axially extending distribution groove.

11 Claims, 2 Drawing Sheets

NON-CRESCENT SEAL INTERNAL GEAR PUMP WITH SEALING ELEMENTS INSERTED IN THE TOOTH TIPS

BACKGROUND OF THE INVENTION

The present invention relates to a non-crescent seal internal gear pump for generating high pressure, and particularly to sealing elements in the gear teeth.

A pump of this generic type is disclosed in DE 41 40 293 C2 which corresponds to U.S.Pat. No. 5,399,079.

Internal gear pumps generally have an internally toothed ring gear which surrounds an externally toothed pinion with a smaller number of teeth. The sets of teeth mesh in driving engagement at one circumferential region around the gears. As a rule, the toothing of this type of pump is relatively narrow in relation to the diameter of the pinion or of the ring gear. Because the volumetric flow to be conveyed is determined by the radial height of the teeth and the width (or axial length) of the toothing along the rotation axis, volumetric flow is limited for design reasons in current pumps. Non-crescent seal internal gear pumps have, in particular, the advantage of a minimal overall volume.

To improve the tightness of the pump between the tooth tips of the pinion and the ring gear, DE 41 40 293 C2 discloses a sealing element inserted in each of the tooth tips of the ring gear, specifically in a dovetailed profile groove in the tooth tip. The profile groove also limits the radial movement of the sealing element. The profile groove therefore virtually acts as a radial limit for the sealing element.

If the sealing element has reached its (radially outer) end position, the two side faces of the sealing element rest with an exact fit on the side faces of the profile groove. As seen over the axial direction width of the toothing, a specific defined pressure distribution is thereby no longer ensured. This may lead to undefined or variable operating states of the pump.

SUMMARY OF THE INVENTION

It is an object of the present invention to provide a non-crescent seal internal gear pump of the generic type, in which the above-mentioned problems are absent.

A non-crescent seal gear pump includes a housing with a pump chamber, a rotatable ring gear in the pump chamber having an outer periphery and internal toothing and an eccentric pinion with external toothing and rotatable in mesh with the rotatable ring gear, a suction connection to the housing of the pump at one circumferential section of the ring gear and a delivery connection to the housing at another circumferential section around the ring gear. The eccentric pinion meshes with the ring gear at one circumferential side of the ring gear between the suction and delivery connections and the pinion passes by the teeth of the ring gear at the other circumferential side of the ring gear. Perforations through the ring gear pass fluid into and out of the chamber formed between the pinion and the ring gear.

The tooth tips of the ring gear have dove-tail shaped profile grooves in which are inserted radially movable sealing elements that are profiled to be supported in the dove-tail grooves and to be movable radially slightly. The sealing elements in the ring gear and the teeth of the pinion are so placed as to slide past each other at the other circumferential side of the ring gear.

A distribution groove is worked into either the wall of the profile groove and/or into the sealing element at the wall and the distribution groove extends axially along the sealing element. Radial legs may project outwardly from the axially extending distribution groove.

The essence of the present invention is that the sealing element and/or the profile groove are designed such that at least one distribution or control groove for causing pressure equalization is worked in along at least one of the resting faces between the sealing element and the profile groove for the sealing element.

Other features and advantages of the present invention will become apparent from the following description of the invention which refers to the accompanying drawings.

BRIEF DESCRIPTION OF THE DRAWINGS

FIGS. 2–5 show, in each case, a detail according to "Z" from FIG. 1 wherein;

DETAILED DESCRIPTION OF THE INVENTION

Figure 1:
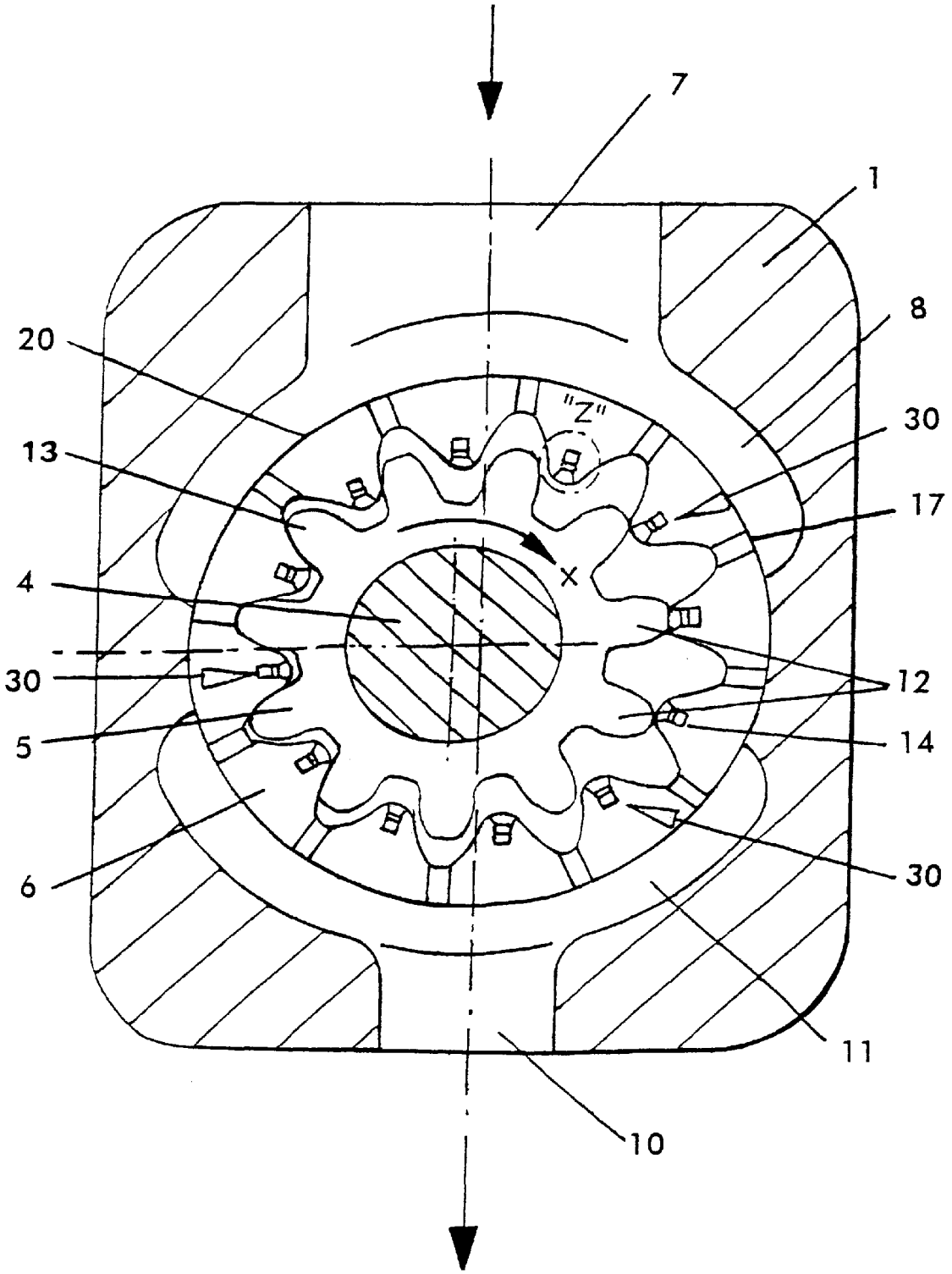
FIG. 1 shows a cross section through a non-crescent seal internal gear pump in the region of the two gearwheels.

FIG. 1 shows, in cross section, a non-crescent seal, head sealing internal gear pump with backlash, with sealing in each case by means of one gear tooth flank. The pump is shown in the region of a housing 1 which may be adjoined by further housings in the axial direction. In the housing 1 are an externally toothed pinion 5 with teeth on its exterior, which is fastened on a drive shaft 4 and is in engagement with an internally toothed ring gear 6 having internal toothing 12 on its interior. The pinion 5 and the ring gear 6 are not mounted coaxially, but rather are mounted eccentrically to one another toward one circumferential side of the ring gear which is on one side of a line between the below described suction and delivery connections 7, 10. Furthermore, the pinion 5 has one tooth fewer than the ring gear 6, so that during rotation the outside of a tooth tip 14 on the pinion contacts the ring gear 6 as described below.

A suction connection 7 is connected to the housing in the circumferential zone of the pump chamber in the housing in which the teeth on the pinion 5 and the ring gear 6 rotating in the direction of the arrow X come out of engagement. In the housing 1, where the ring gear 6 and the pinion 5 are mounted, the suction connection 7 is adjoined in each circumferential direction in relation to the adjacent housing parts, by a suction pocket 8 which extends over part of the outer peripheral surface 20 of the ring gear 6.

A delivery connection 10 connected to the housing 1 likewise communicates into a delivery pocket 11 and the pocket 11 extends over a greater region of the circumference of the ring gear 6 than the connection 10. The delivery connection 10 is located on the opposite circumferential side of the pump from the suction connection 7. The inflow of the pressure medium to the interior of the pump chamber, to the tooth spaces in the pinion 5 and in the ring gear 6, which tooth spaces cause the pressure medium to be conveyed, takes place via radial perforations 17 or bores that extend radially through the ring gear 6. These perforations 17 start from the outer surface 20 of the ring gear 6 and open out in each tooth bottom of the gear 6.

In FIG. 1, sealing elements 30 are inserted in each tooth tip of the ring gear 6 and extend over the axial length of the teeth. The sealing elements seal off the toothing 12 between the pinion 5 and ring gear 6, as seen in the direction of rotation of the pinion 5. At the circumferential side at the right in FIG. 1, the sealing elements contact the tips of the teeth of the pinion 5 as the teeth pass each other during rotation.

The embodiments in FIGS. 2, 3, 4 and 5 show sealing elements 30 positively fitted in dovetail-like profile grooves 34 in each of the tooth tips of toothing 12. The dove-tail shape retains the sealing element in the groove 34. Other respective profiling of the sealing element and the groove may be selected for that purpose. The side/contact faces i.e. the opposed resting faces of the groove 34in the tooth tip and the opposite support faces of the sealing element 30 may be designed to ensure a uniform pressure distribution and therefore a stable operating behavior of the pump over the width of the toothing 12. FIGS. 2 to 5 each illustrate, at location "Z" in FIG. 1, a sealing element 30 which is inserted into a profiled groove 34 of the ring gear, specifically, on the one hand, in a similar way to FIG. 1, in a top view and, on the other hand, in a side view, arrows II, III, IV and V in each case indicating how the side view is to be seen. The grooves 34 allow of some radial displacement of the sealing element 30, which compensates for manufacturing tolerances. Due to leakage of pressure medium past the sealing elements 30 and due to the radial shifting of sealing elements in their grooves, pressure medium may enter the grooves 34 and may resist radial movement of the sealing elements. The below described distribution groove embodiments resolve these problems.

Figure 2A:
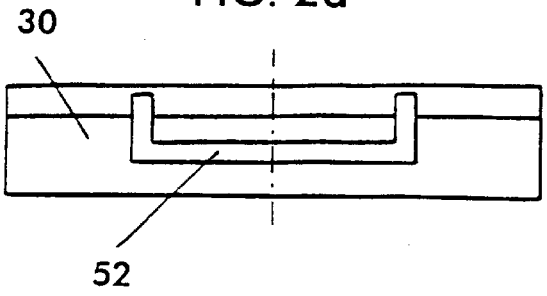
FIGS. 2*a* and 2*b* are respectively an axial view and a transverse cross-section of a first embodiment of a sealing element in a ring gear tooth tip.
Figure 2B:
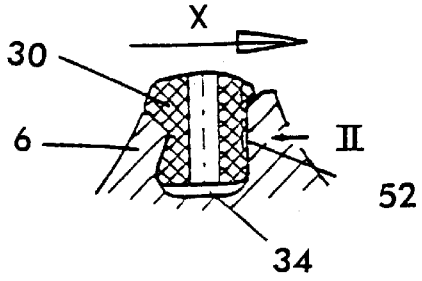

FIGS. 2*a* and 2*b* show a first embodiment, according to which a groove 52 is worked into the leading side face of the sealing element 30, with respect to the direction of rotation X of the pinion 5. As may be seen from the side view, the groove 52 is drawn upward at its two ends toward the head of the sealing element 30. The groove 52 provides a place for leaked pressure medium to gather. Radial legs of the groove enable escape of fluid and may distribute the medium and the pressure along the groove.

Figure 3A:
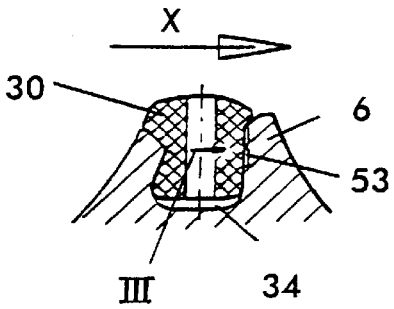
FIGS. 3*a* and 3*b* respectively show transverse cross-section and axial views of a second embodiment.
Figure 3B:
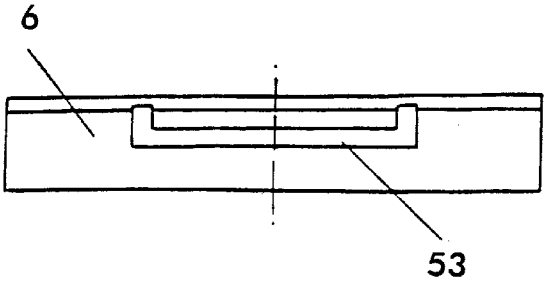

FIGS. 3*a* and 3*b* show a second embodiment, in which a groove 53 is worked into the leading side face of the profile groove 34, with respect to the direction of rotation X. The side view shows that here too, the groove 53 is drawn up at both ends on the pinion in relation to the head of the radial groove 34 or of the tooth tip.

Figure 4A:
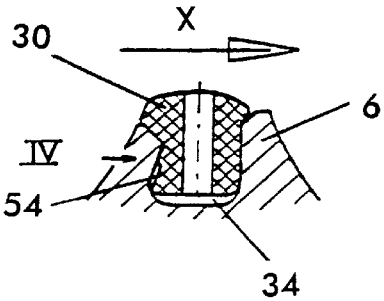
FIGS. 4*a* and 4*b* respectively show transverse cross-section and axial views of a third embodiment.
Figure 4B:
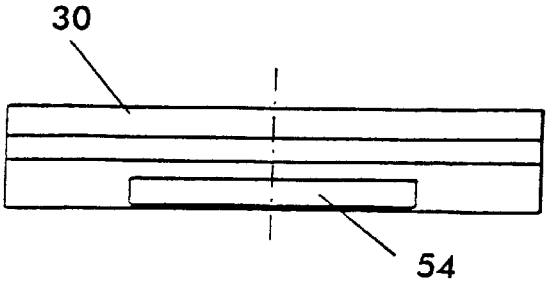

FIGS. 4*a* and 4*b* show a third embodiment, in which a groove 54 is worked in on the trailing side face of the sealing element 30, with respect to the direction of rotation X.

Figure 5A:
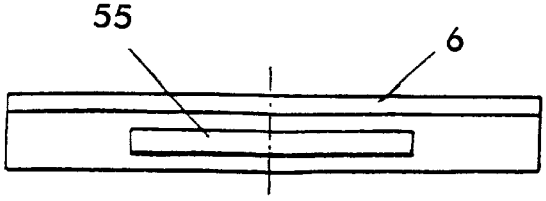
FIGS. 5*a* and 5*b* respectively show an axial and a transverse cross section of a fourth embodiment.
Figure 5B:
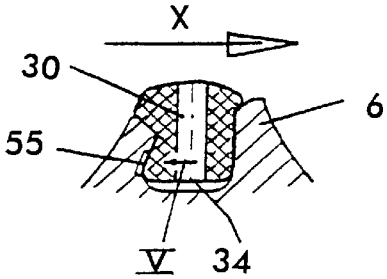

FIGS. 5*a* and 5*b* show a fourth embodiment, in which a groove 55 is worked in on the trailing side face of the radial groove 34 with respect to the rotation direction X.

In conclusion, in the embodiments in FIGS. 2, 3, 4 and 5, the grooves 52, 53, 54 and 55 in the side faces of the sealing element 30 and/or of the radial groove 34 ensure a definite pressure distribution transversely to or axially in relation to the toothing. If appropriate, and according to the exemplary embodiments illustrated, some of the groove arrangements may also be implemented in combination.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A non-crescent seal gear pump comprising:

a housing with a pump chamber within the housing, a ring gear rotatable in the pump chamber around a rotation axis, the ring gear having a periphery and having an interior with internal teeth; radial perforations passing through the ring gear from the periphery to the interior thereof for passage of pressure medium therethrough;

a pinion rotatably supported inside the ring gear, the pinion having an exterior with external teeth thereon which mesh with the internal teeth of the ring gear, a rotation axis of the pinion being eccentric of the rotation axis of the ring gear so that the teeth of the pinion most fully mesh with the teeth of the ring gear toward one circumferential side;

a suction connection to the housing and communicating with the ring gear perforations at one circumferential region of the periphery of the ring gear; a pump fluid delivery connection to the housing and communicating with the perforations at another circumferential region of the periphery of the ring gear;

the teeth of the ring gear having tips, a respective shaped groove formed in each ring gear tooth tip and extending along the axial direction of the respective tooth tip;

a radially movable sealing element installed in each of the shaped grooves, the sealing element and the shaped groove being respectively cooperatingly shaped for holding the sealing element in the shaped groove and for permitting the sealing clement to move radially slightly with reference to the respective tooth tip, and the sealing element being so placed as to engage a respective tooth of the pinion during rotation of the ring gear and the pinion as the pinion rotates past the ring gear;

the shaped groove in the tooth tip of the ring gear having opposed resting faces which respectively lead and trail the shaped groove with respect to the direction of rotation of the ring gear and the resting faces defining the shaped groove, and the sealing element having leading and trailing support faces which rest respectively on the leading and trailing resting faces for holding the sealing element against exiting the shaped groove;

at least one distribution groove formed in at least one of the resting faces of the groove and the support faces of the sealing element for permitting distribution of pressure medium along the groove.

2. The pump of claim 1, wherein each of the tip grooves is dove-tail shaped between the opposed resting faces and extending along the axis of the gear pump and the respective sealing element in the groove is correspondingly dove-tail shaped between the support faces.

3. The pump of claim 1, wherein the ring gear has the tooth tips at which the shaped grooves are located and has tooth bottoms between the tooth tips, and the perforations extend from the periphery of the ring gear to the tooth bottoms.

4. The pump of claim 1, wherein the suction connection and the delivery connection each have a first circumferential extent in the housing; a respective circumferentially elongate pocket space around the periphery of the ring gear communicating with each of the suction connection and the delivery connection and each pocket being circumferentially wider than the respective connection with which it communicates.

5. The pump of claim 1, wherein the distribution groove is in one of the support faces of the sealing element.

6. The pump of claim 1, wherein the distribution shape groove is in one of the resting faces of the groove.

7. The pump of claim 1, wherein the ring gear has a greater number of teeth than the pinion.

8. The pump of claim 7, wherein the diameters of the pinion and the ring gear and the radial length of the teeth thereof are selected so that toward the one circumferential side of the pump chamber which is also toward one circumferential side of both the suction connection and the delivery connection, the teeth of the pinion extend further toward the bottoms of the teeth of the ring gear and so that at the opposite circumferential side of the pump chamber and of both the suction connection and the delivery connection, the pinion teeth pass above the tooth tips of the ring gear.

9. The pump of claim 8, wherein at the other circumferential side of the housing, the sealing elements are of such radial height that the teeth of the pinion contact the sealing elements.

10. The pump of claim 1, wherein the distribution groove extends in the axial direction along the respective tooth and the sealing element.

11. The pump of claim 10, wherein the distribution groove includes a plurality of radially outwardly directed legs communicating with the axial direction portion of the groove.

* * * * *